US005300739A

United States Patent [19]

Bittar

[11] Patent Number: 5,300,739

[45] Date of Patent: Apr. 5, 1994

[54] CYCLICALLY VARYING AN ELEVATOR CAR'S ASSIGNED GROUP IN A SYSTEM WHERE EACH GROUP HAS A SEPARATE LOBBY CORRIDOR

[75] Inventor: Joseph Bittar, Avon, Conn.

[73] Assignee: Otis Elevator Company, Farmington, Conn.

[21] Appl. No.: 887,946

[22] Filed: May 26, 1992

[51] Int. Cl.[5] ..... B66B 1/18

[52] U.S. Cl. ..... 187/127; 187/128

[58] Field of Search ..... 187/124, 127, 128, 126

[56] References Cited

U.S. PATENT DOCUMENTS

| | | | |
|---|---|---|---|
| 4,298,100 | 11/1981 | Süss et al. | 187/126 |
| 4,836,336 | 6/1989 | Schroder | 187/121 |
| 5,092,430 | 3/1992 | Goto et al. | 187/122 |
| 5,183,981 | 2/1993 | Thangavelu | 187/128 |

FOREIGN PATENT DOCUMENTS

| | | | |
|---|---|---|---|
| 1231793 | 12/1989 | Japan . | |
| 4153169 | 5/1992 | Japan | 187/121 |

*Primary Examiner*—Steven L. Stephan
*Assistant Examiner*—Robert Nappi
*Attorney, Agent, or Firm*—Breffni X. Baggot

[57] ABSTRACT

Elevator swing cars 37 have doors 50 opening into a low rise lobby service corridor 31 and doors 51 opening into a medium rise lobby service corridor 32 with car panels 52 associated with the low rise group of floors (such as floors 1–13) and car panels 53 associated with floors of the medium rise group of floors (such as floors 14–22). Each swing car is assigned (FIG. 12) to either one of the two groups which it can serve at the conclusion of each run, as the car approaches the lobby, thereby operating an enunciator lantern 56 in the low rise corridor 31 or an enunciator lantern 57 in the medium rise corridor 32, depending upon which rise the elevator has been assigned to for service in the next following run. Similar swing cars 39 relate to the medium rise (32) and the high rise (33). A variety of alternatives and features are disclosed.

29 Claims, 9 Drawing Sheets

CYCLICALLY VARYING AN ELEVATOR CAR'S ASSIGNED GROUP IN A SYSTEM WHERE EACH GROUP HAS A SEPARATE LOBBY CORRIDOR

TECHNICAL FIELD

This invention relates to cyclically varying the number of elevators in related elevator groups.

BACKGROUND ART

There is a half century of history of schemes which have been implemented for improving the efficiency of elevators. Among these are ways of determining which car shall answer a hall call, such as the relative system response dispatchers disclosed in U.S. Pat. Nos. 4,363,381, 4,815,568, to Bittar, and 5,024,295. Others involve peak period dispatching, including zoning and channeling, some of which is disclosed in U.S. Pat. Nos. 4,792,019 and 4,838,384. And, to improve further on such systems, various forms of traffic prediction estimates have been used. The systems become more sophisticated with techniques which have been variously referred to as artificial intelligence, fuzzy logic and so forth. All of the foregoing relate to efficient operation of the elevators within a group.

To achieve more efficient operation of tall buildings (in excess of, say, 20 floors) buildings have been provided with groups of elevators, one group operable only to the lowermost 10 or 15 floors, and the other group operable only in the highest floors of the building, in which case the groups are referred to as the "low rise" and the "high rise". The elevators in the low rise are incapable of reaching a floor in excess of the high end of the low rise. The elevators in the high rise have no access to floors in the low rise: there are no gates; there aren't even any elevator lobbies adjacent to the high rise elevators in the low rise floors. In even taller buildings, there may be low rise, medium and high rise, or even more rises. For exemplary purposes herein, a building having a low rise serving floors 1–13, a medium rise serving floors 14–22, and a high rise serving floors 23–30 will be referred to.

One of the tricks in designing a building is to have a fair estimate of floor usage which will permit predicting how many elevators will be required to serve the various floors, and therefore the grouping of elevators into low, medium and high rises. It isn't just the number of elevators in the building, but their accurate allocation to the correct rises which will prove to be successful or not, in handling the tenant and other traffic amongst the floors of the building.

It has been known to provide a "swing car" which may be swung out of a group (whether the group be the only group in the building or not) so as to operate independently of that group, either in simplex mode with its own riser (a riser consisting of hall call buttons and hall enunciator lanterns) or in another group. Such operation may be to accommodate public access to a rooftop restaurant after normal closing hours of an office building, or preferential floors in luxury hotels and apartments, and the like. Such cars can also provide emergency operation when a group controller ceases to function.

A system capable of swinging an elevator between groups, and from operation within the group to simplex operation, is disclosed in a commonly owned, co-pending application entitled "Elevator Car and Riser Transfer", U.S. Ser. No. 07/853,678, filed on Mar. 19, 1992, by Meguerdichian et al. However, the value that a swing car from one group has in handling traffic in another group is severely hampered by the physical location of the swing car and the need to usher passengers specially to it, typically by means of lobby dispatching personnel. Additionally, the swinging typically has to be anticipated for some significant period of time to make it worthwhile to cause the car to be swung from one group to another. Thus, the use of the swing car is not of much value during rapidly changing traffic patterns (such as during the noon rush of a three-rise building), or handling severely bunched up traffic as may result from the conclusion of a banquet on a restaurant floor, or the conclusion of class time on floors having bulk educational classes, and the like.

DISCLOSURE OF INVENTION

Objects of the invention include significant improvement in the capability of rapidly adjusting the number of elevator cars in related groups of elevator cars serving different floor sets of a building.

This invention is predicated on the discovery that swing car operation should be controlled on an every cycle basis with the possibility, and real likelihood, of assigning each swing car to a different group each time that it completes a trip. The invention takes advantage of the precept that regardless of the floors at which persons enter an elevator, they are not concerned with which lobby service corridor they are delivered to, and therefore can be delivered to the lobby service corridor of a group other than the group under the control of which the passengers entered the car at floors above the lobby. The invention is also predicated on the discovery of the fact that elevator cars which are located within the lobby service corridor dedicated solely to one group can also be located in the lobby service corridor dedicated solely to a second group.

According to the present invention, an elevator car has doors on two sides operable to allow passage of passengers between the car and either one of two distinct lobby service corridors, each corridor serving a different set of floors of the building, which are opened to the lobby service corridor associated with the set of floors to which it has been assigned for its next run as it approaches the lobby floor at the conclusion of a current run, without regard to which set of floors it had been assigned to during the current run. In accordance with the invention, in normal operation, one or more swing cars are assigned to group controllers related to one or more sets of floors each time that the swing car concludes a run and approaches the lobby floor. In further accord with the present invention, a plurality of cars are each assignable between a pair of elevator groups having distinct lobby service corridors. According to the invention, elevators can be (relatively) permanently assigned to different groups, or may be assigned to a group each time it descends to the lobby, without regard to the group to which it was assigned during the previous run.

The invention facilitates the use of a fewer number of elevators to serve a given anticipated traffic requirement in a building having the floors arranged in rises operated as separate groups. The invention can save not only the cost of one or several complete elevator shafts, but can also restore the capability of the building to generate rent on the order of ½ an office per floor of the lower rise of the two rises between which elevators may be swung in accordance with the present invention. If a single swing car can serve the need for one low rise shaft and one high rise shaft, it thereby saves the floor space which the low rise shaft would have occupied. In the example herein, for eliminating one dedicated low rise elevator, this would comprise about fifteen floors of additional office floor space the size of an elevator shaft, including the machine room, etc. Of course, a swing car capable of operating in two of the rises of a building costs more than a car that is dedicated to only one rise in the building for additional doors, car operating panels, and lights. However, the remaining structure is the same as it would be for the higher of the two rises, so the incremental cost is relatively low compared with additional entire elevator systems (hoistways and the like) and the lost rental from use of building space for non-revenue service.

In accordance with another aspect of the present invention, the fact that swing car assignments can be made once for each run that the elevator is about to make means that there is no need for fancy schemes to determine whether the elevator should be assigned to one group or the other. Nor is there any need to balance a tie if both are equally in need thereof. The reason is that in any cycle when an elevator is being assigned, it can be assigned to one of the groups and help that group out. Within minutes, either itself or a companion swing car can be assigned to the other group to help that group out. Within minutes it can be reassigned to the second group or it can be assigned back to the first group. The point being that no fancy determination has to be made because the determination can be reversed on a cyclic, per-run basis. And, once an elevator is assigned to a group, it simply is added into the software for that group and can be handled in the same fashion as any other elevator in that group. There is no need for any other specialties of any sort whatsoever. And furthermore, the same, cyclic assignment aspect of the present invention means that there is no need to care about whether, for example, a low rise is so burdened that it steals the swing cars away from the medium rise so that the medium rise, which is also heavily burdened, must then steal them from the high rise. They will simply do so on a cyclic basis. In other words, there is no need to recognize that cars should be shifted from the high rise to the medium rise so they can be shifted from the medium rise to the low rise.

The invention also avoids the necessity to have a median assignment in which a swing car is split on an alternating basis between two rises. At each assignment, it will simply go with the one that needs it the most. And if it had been assigned to one of the rises during one run, the other rise (if equally burdened with total traffic) will have a higher burden per car during that run, thereby causing the assignment to swing back. In other words, it is completely self-leveling as between two groups (rises) that the swing car can be assigned to. Similarly, although traffic anticipation including up peak period and the like can be utilized as a method for preferentially assigning a swing car to one or the other of the groups in dependence upon what is anticipated that the traffic will be, it isn't necessary to do so since, if in fact the traffic materializes in one group or the other, the car will be assigned thereto in a matter of moments.

The present invention is implementable using nothing but apparatus and software techniques which are well known in the art, in the light of the teachings hereinafter. For instance, the same double door, multi-panel elevators that are used in splitfloor buildings and in hospitals and the like are perfectly suitable for use in accordance with the present invention, provided the operating panels are suitably arranged for each rise, as desired. Even so, these may be the same operating panels that would be utilized in the dedicated elevators for the groups relating to the individual rises.

Yet another advantage of the present invention is that it does not require steering passengers. The passengers can head for the low rise corridor or the mid-rise corridor or the high rise corridor, guided only by non-varying fixed signs the same as if only dedicated elevators were serving those corridors. And, when they arrive at the corridor they may be served by a dedicated elevator or they may be served by a swing elevator. There is no difference to the passengers, and passenger behavior does not have to be altered in any fashion in order to take advantage of the present invention.

This is a wide departure from all prior multi-usage elevator features known to the art.

Other objects, features and advantages of the present invention will become more apparent in the light of the following detailed description of exemplary embodiments thereof, as illustrated in the accompanying drawing.

BEST MODE FOR CARRYING OUT THE INVENTION

Figure 1:
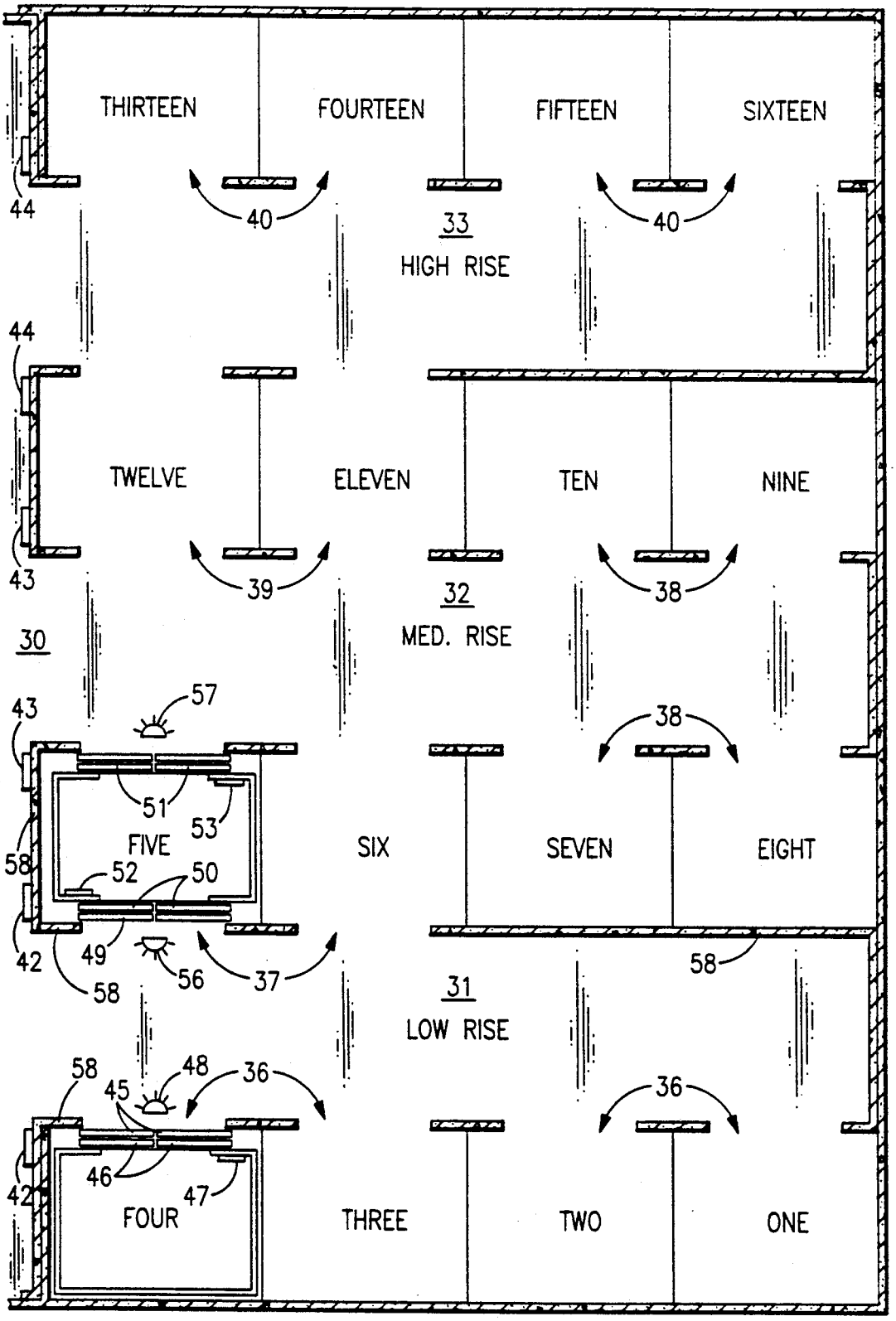
FIG. 1 is a simplified, sectioned partial plan view of the lobby level of an elevator system employing the present invention.

Referring now to FIG. 1, the lobby floor of a building having an elevator system incorporating an embodiment of the present invention has a general lobby area 30 which feeds into three corridors 31–33 designated as low rise, medium rise and high rise. The corridors 31–33 serve sixteen elevators 36–40. The elevators 36 are designated one-four and serve the low rise group of the building in a dedicated fashion, being only capable of reaching the low rise floors (floors 1–13 in the example herein). The elevators 37 are designated five and six and are capable of operating either with the low rise group of elevators 36 or with the medium rise group of elevators 38. The elevators 38 are designated seven-ten and are dedicated to operating with the medium rise group. The elevators 39 are designated eleven and twelve and are capable of operating with the elevators 38 of the medium rise group or with the elevators 40 of the high rise group. The elevators 40 are designated thirteen-sixteen and are dedicated to operation with the high rise group.

To designate the corridors 31–33, a number of fixed, non-varying signs 42–44 are provided. The signs 42 would each point to the low rise corridor 31 and designate floors 1–13. The signs 43 would each point to the medium rise corridor 32 and indicate floors 14–22. The signs 44 would each point toward the high rise corridor 33 and designate the floors 23–30. This is one aspect of the present invention: that the variable size rises (or groups) can be accommodated without steering the passengers in any particular fashion; the passengers always entering the appropriate corridor 31–33 in dependence upon the floor to which they are traveling, prompted by fixed signs 42–44 of the normal type.

Elevator four 36 is illustrative of all of the dedicated elevators 36, 38, 40 having a single set of gates 45 and doors 46 and a single car operating panel 47. However, two identical panels could be provided on either side of the doors 46 in each of these cars, as is common when the elevator cars are relatively large. Each of the committed elevators 36, 38, 40 has a single lantern 48 which is illustrated in FIG. 1 with respect to car four as being above the entry to the doors 46. The terms "doors" and "gates" are meant to include a single door and a single gate, respectively.

Figure 2:
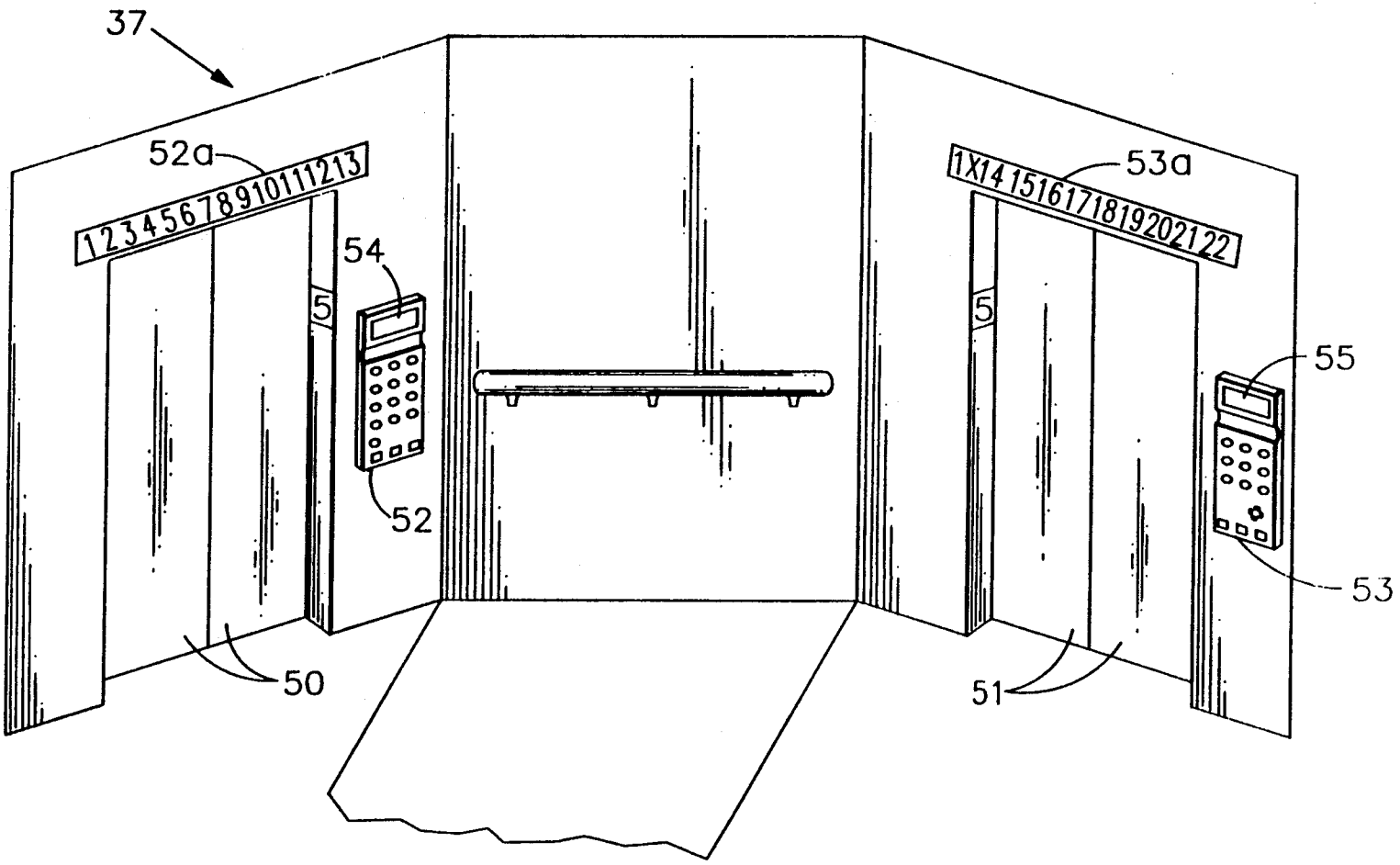
FIG. 2 is a simplified, exploded perspective view of three sides of the inside of a swing car elevator in accordance with the present invention showing the doors and car operating panel for the low rise to the left of the figure and showing the doors and car operating panel for the medium rise to the right of the figure.
Figure 3:
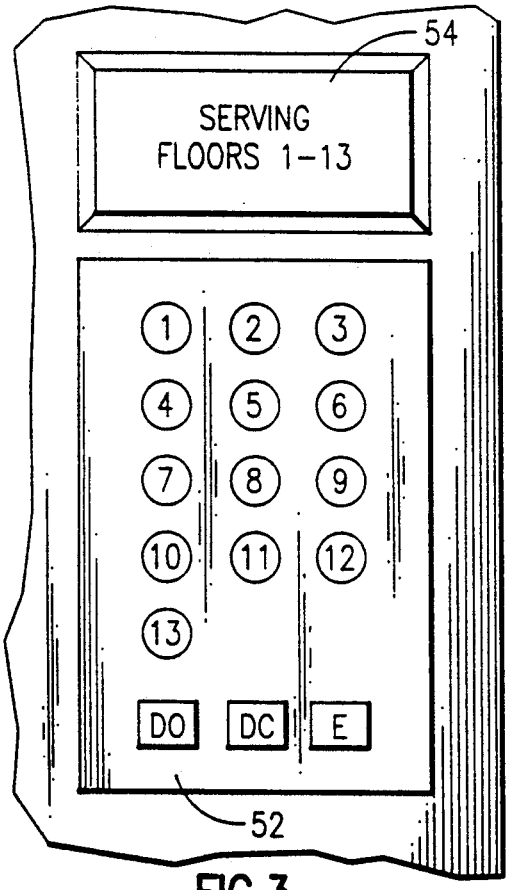
FIG. 3 is an elevation view of a low rise elevator car operating panel and signal for a swing car when it is serving a low rise.
Figure 4:
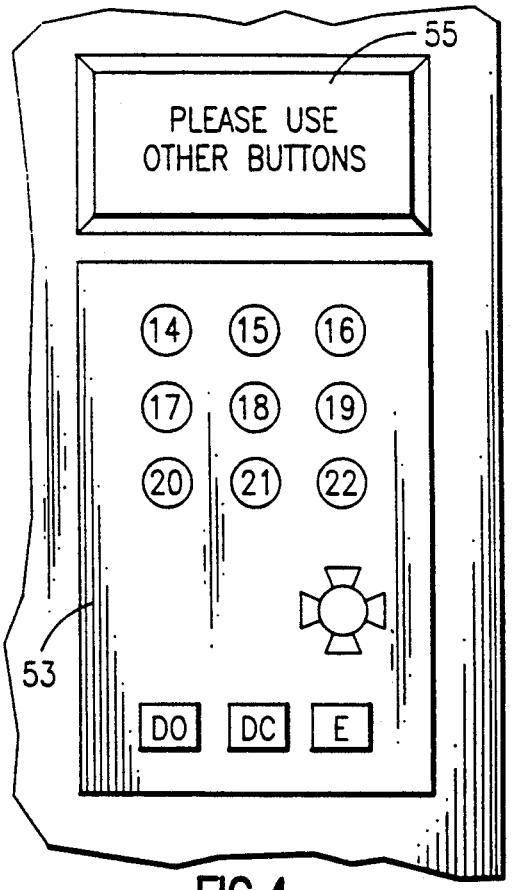
FIG. 4 is an elevation view of a medium rise elevator car operating panel and signal of a swing car when it is serving a low rise.
Figure 5:
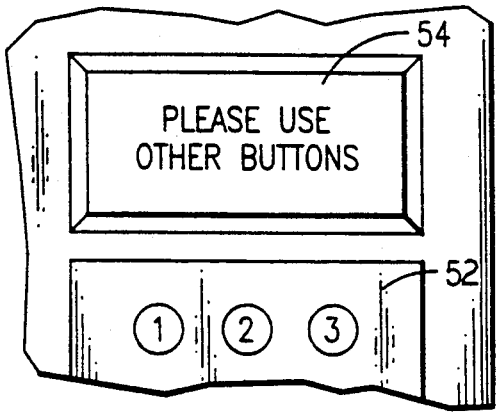
FIG. 5 is a partial elevation view of the panel and signal of FIG. 2 when the car is serving the medium rise.
Figure 6:
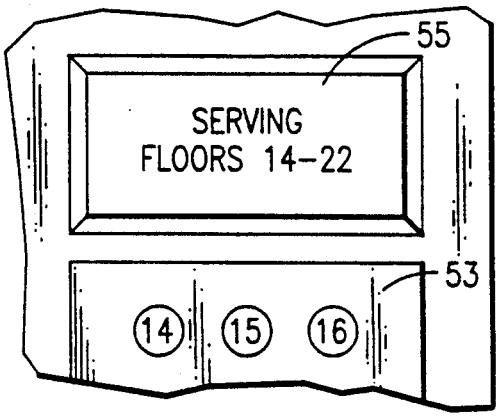
FIG. 6 is a partial elevation view of the panel and signal of FIG. 3 when the car is serving the medium rise.

On the other hand, elevator five 37 is illustrative of the elevators 37, 39 having two sets of gates 49 and doors 50, 51 and two different car operating panels 52, 53 each uniquely associated with one of the sets of doors 50, 51. The interior of car five is illustrated more fully in FIG. 2. When people enter the doors 50 they will typically tend to turn to the right of the doors and operate the car operating panel 52. If desired in a very large elevator, there can be two car operating panels 52, one on either side of the doors 50. Similarly, should passengers enter the car through doors 51, they would turn to the right of those doors and operate the car operating panel 53. Again, in a large car or if desired for any reason, two car operating panels 53 could be provided, one on either side of the doors 51. The important thing is that, in accordance with the invention, swing cars may be provided with car operating panels adjacent to a given set of doors which relate only to the floors of the rise corresponding to the corridor through which those doors are accessed, or the car panels may each have call buttons for all the floors the car can serve (e.g., both rises). In order to further simplify it for the passengers, it is possible to provide an electric enunciator display 54, 55 fairly close to each of the panels 52, 53 to inform the passengers either to use the particular car operating panel 52, 53 to reach floors designated, or to inform passengers that the particular operating panel is not in service. This is illustrated in FIGS. 3 and 4 wherein the panel 52 is identified by the display 54 as currently "SERVING FLOORS 1–13", while at the same time the display 55 informs passengers not to use the panel 53 by the legend "PLEASE USE OTHER BUTTONS", or some other suitable legend. The case with respect to FIG. 3 and 4 is when passengers have entered through the doors 50 (FIG. 2) from the low rise lobby service corridor 31 in response to a low rise car five lantern 56, with an intent to reach floors 1–13. Should car five be assigned to the medium rise, passengers will enter through the doors 51 from the medium rise corridor 32 in response to a medium rise car five lantern, with an intent to reach floors 14–22, and the displays 54, 55 will be informing them to use the panel 53 rather than the panel 52, as seen in FIGS. 5 and 6. As used herein, the panels 52, 53 are deemed to include the car's floor indicating means, such as lights 52*a*, 53*a*. Alternatively, the display 54, 55 may likely display the floors as they are reached, which is a common feature, and the lights 52*a*, 53*a* need not be used. However, each panel can have the full set of car call buttons for all floors the car may reach in both rises, if desired; then, the buttons for the floors not being served will be disabled (ignored) preferably in a way that is apparent to the passengers.

The lobby and elevator arrangement illustrated in FIG. 1 is almost ideal in that it provides three clear corridors 31–33 which allow the use of 16 elevators to provide essentially the service of 18 elevators since any one of the three rises can have between four and six cars therein (provided not all three have six cars at one time). The arrangement is ideal because the general appearance of dedicated elevators serving a particular corridor to reach particular floors is maintained even though there are swing cars. Passengers in the low rise lobby service corridor 31 can see the enunciator lantern 56 for car five, but they cannot see the enunciator lantern 57 for car five that is disposed above its doors 51 in the medium rise lobby service corridor 32. When in the low rise lobby service corridor 31, all that people see is six closed sets of doors and some marble 58, which is what they are accustomed to seeing. When any given door opens, whether it be in the elevators 36 or the elevators 37, there is no surprise, since they enter the elevator and find a car operating panel that allows them to select the floor that they wish. All architectural aesthetics are preserved and all functionality is maximized in this way.

Figure 7:
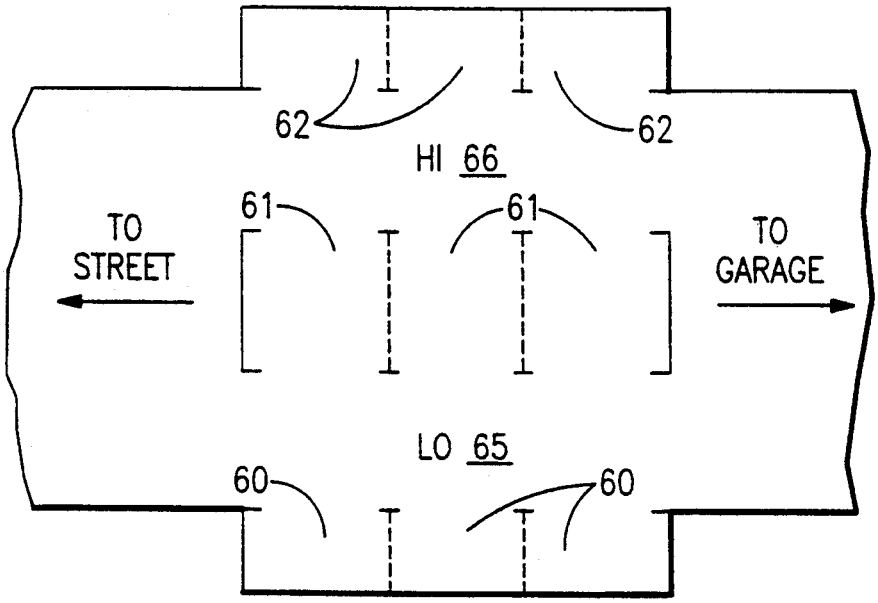
FIG. 7 is a simplified sketch, similar to the plan view of FIG. 1 illustrating another configuration of dedicated cars and swing cars arranged in a low and high rise system.

Of course, any number of elevators in any number of groups with any number of corridors are theoretically capable of taking advantage of the present invention. To illustrate some of the features that are not important to the invention, reference is made to FIGS. 7 and 8. In FIG. 7, nine elevators 60–62 are arranged in a low rise bank in a low rise corridor 65 and a high rise bank in a high rise corridor 66; the swing bank of elevators 61 can serve either corridor 65 or corridor 66. In some circumstances, this arrangement could probably take the place of a system having two banks of six elevators each to serve the low rise and the high rise groups.

Figure 8:
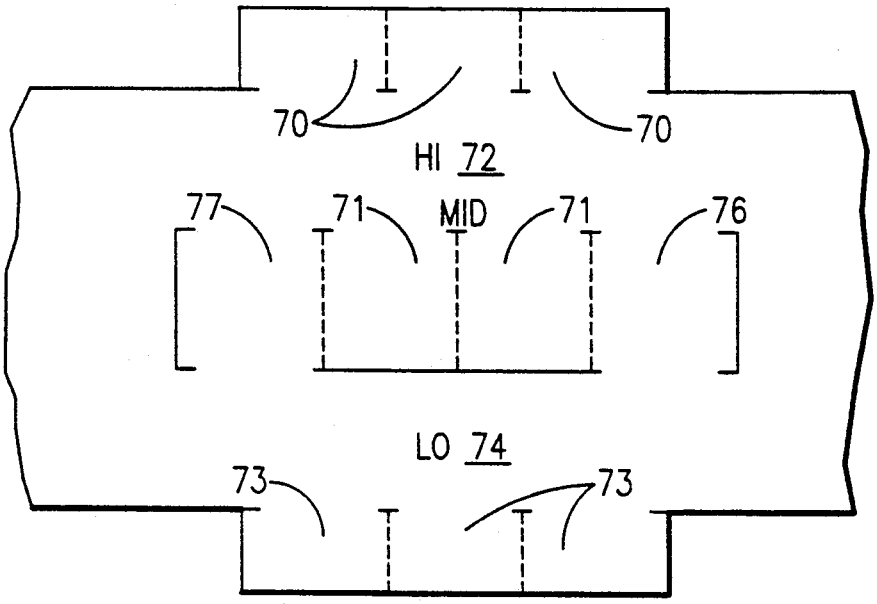
FIG. 8 is a simplified sketch similar to the plan view of FIG. 1 of another configuration of dedicated cars and swing cars in a three rise system using two corridors in which all three rises share two elevators, in an alternative form of the invention.

A stranger situation is illustrated in FIG. 8 in which there are two sets of dedicated elevators 70, 71 sharing a corridor 72 and a third set of elevators 73 in its own corridor 74. In addition, a pair of swing cars 76 can serve either corridor and therefore any one of the three rises. This has the advantage of being able to use the swing cars in three different groups, but it has the disadvantage of having to mingle the high rise and mid rise passengers, and then having to have lighting on the elevators 77 so as to identify to the passengers that they should enter one of the swing cars to reach the high rise or the medium rise from the lobby service corridor 72, depending on the floor group to which the elevator has been assigned. On the other hand, in the low rise corridor 74, no such signs would be required since the swing car doors would never open to the corridor 74 unless the swing cars were serving the low rise group. FIGS. 7 and 8 also illustrate that the lobby service corridors can be pass-through, rather than dead-ended as in FIG. 1.

If channeling is to be used, within which even the risers are further broken up into smaller sets of floors in accordance with the aforementioned U.S. Pat. No. 4,804,069, that would have to do only with channeling once a car is in the rise, the same as it is for all dedicated cars in any rise. It would have nothing to do with swing car operation in accordance with the present invention. This is further illustration that once a car is assigned to the group of a particular rise, it becomes a car of that rise, other than the fact that it may be assigned elsewhere for its next run.

As described hereinbefore, one of the great advantages of the present invention is that there is no need for fancy schemes to determine where the swing car should go for a following run, because the swing cars are assigned back and forth, or reassigned in the same way, each time that they complete a run. Thus, a very small amount of function must be added as a burden to the software of existing elevator control systems. The ensuing description of exemplary software is as much illustrative of how little additional software is needed (the software shown having options therein that are not necessary) as it is illustrative of simple examples of how to perform the additional functions. Of course, following the teaching hereof, sophisticated options and alternatives may be used, some of which are described hereinafter, without departing from the basic invention. In some situations, two cars may be swung simultaneously; the assignment function herein can be intermeshed with other assignment and dispatching functions, etc.

Figure 9:
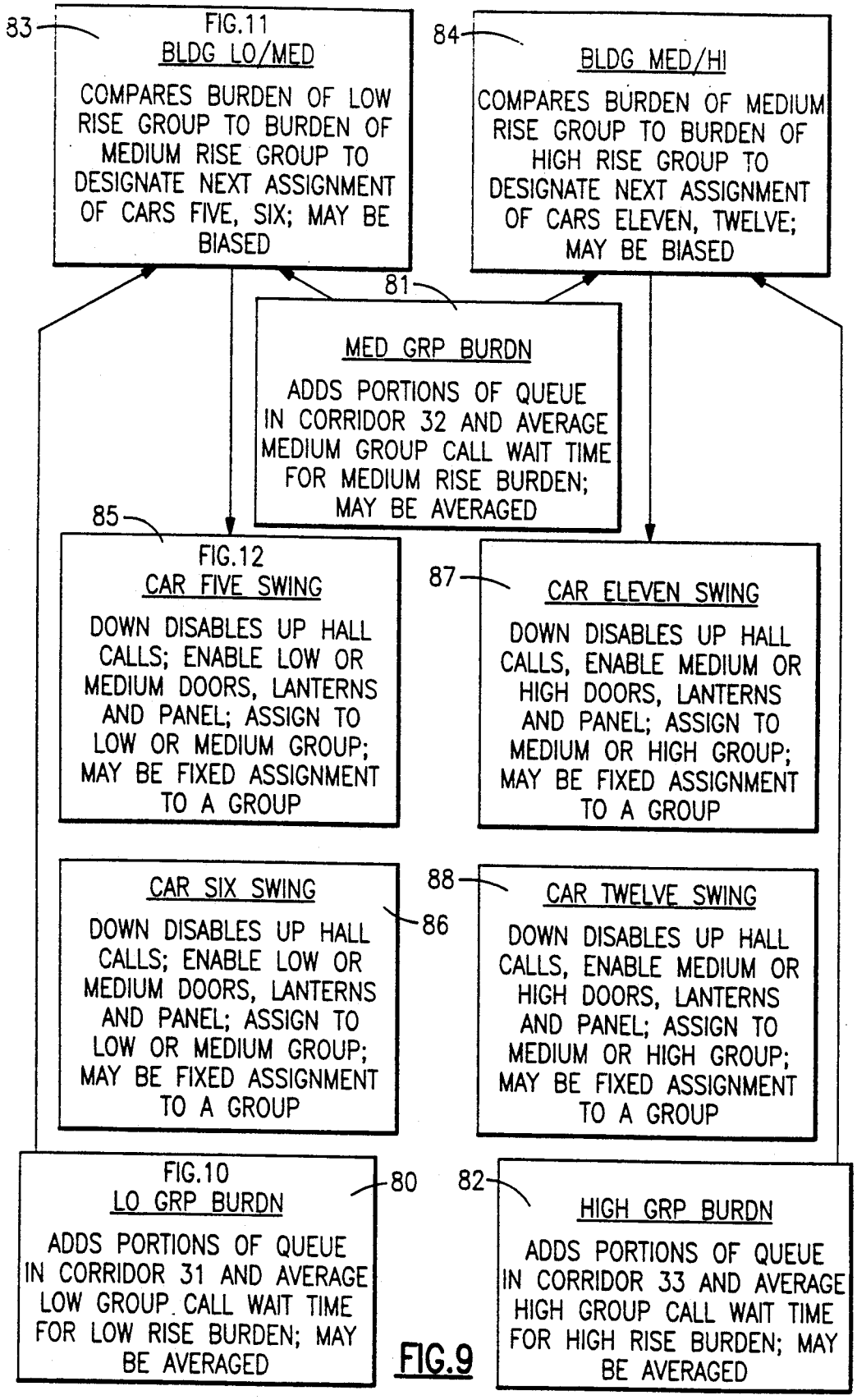
FIG. 9 is a relational diagram of software modules utilized to implement a swing car elevator system of the type illustrated in FIGS. 1–6 (exemplary)

Referring to FIG. 9, each of the groups have a software module 80–82, one of which is described in detail with respect to FIG. 10 hereinafter, which determine how heavily burdened the related group is. In accordance with the invention, there are any number of ways to determine what the relative need for elevators are between the groups that can share swing cars, so as to determine the best allocation of the swing cars. For instance, if one group has an elevator out of service, one of the swing cars can be permanently assigned thereto by the elevator management system (typically under the control of a personal computer in a control room). Or, a lobby dispatcher can visually note an impending overburdening of one of the groups because of the number of people waiting in the lobby service corridor of that group. Predictions can be made of how busy a group will become, if desired. Various other factors relating to the level of traffic or the intensity of interfloor activity may be used. However, one of the best indications of how heavily an elevator group will be burdened is the number of people arriving at the lobby service corridor for that group vs. the number of cars which are available to serve those people. Another indicator of traffic density and intensity of passenger loading is the average amount of time that persons being served by that group have to wait to have their hall calls answered. This is a common dispatching factor, used to control dispatching of elevators within a group. For illustrative purposes, the group burden in the present invention is taken to be some fraction of the queue of passengers waiting in the lobby service corridor associated with each group and some portion of the average amount of time passengers have had to wait for service in response to hall calls, over some period of time such as a number of minutes. Even the burden determined for a given group may itself be averaged over several cycles of determination so as to soften anomalies, if desired, but it is not necessary to do so.

The group burdens prepared by the low group burden software module 80 and the medium group burden software module 81 are values which are made available to a building low/medium software module 83, described with respect to FIG. 11, hereinafter, and the burdens determined by the medium group burden software module 81 and the high group burden software module 82 are values made available to a building medium/high software module 84. These modules simply compare the burdens of the two groups and designate to which of the two groups an available swing car (if any) should be assigned. Although it is not required, it is possible to bias this decision based upon how recently a car was assigned to one of the two groups involved.

The modules 83, 84 simply designate to which group the next swing car assignment should be made; nothing more. This designation is made available by the software module 83 to swing car modules 85, 86 for cars five and six. In these software modules, all that is needed to know is, if it's going to be assigned as a swing car, to which group should it be assigned. In accordance with the invention, the swing cars are assigned at the end of each run, as the car travels down toward the lobby. In order to facilitate switching cars from one group to the other, as the car travels down, the ability of the car to respond or be assigned to up hall calls is disabled. In most systems, up car calls don't have to be disabled since they are calls behind the car and will not register anyway. But if they register and are not cancelled at the lobby, then they should be disabled in the down run. Down calls (car calls ahead of the car in the down direction) must be permitted, because car calls ahead of the car (in the direction of the run) must always be answered. In dependence upon what the related building module 83, 84 has told the individual car, it will enable one set of floor lights, lanterns, doors and panels and assign itself to one of the groups so that it can be controlled in its dispatching in the same fashion as every other elevator in the group (other dedicated cars or swing cars). In the swing car modules 85–88, account is also taken of the fact that an elevator management system may permanently assign the cars to one or another group. These are the only functions that have to be provided for, and are in fact extremely simple.

Figure 10:
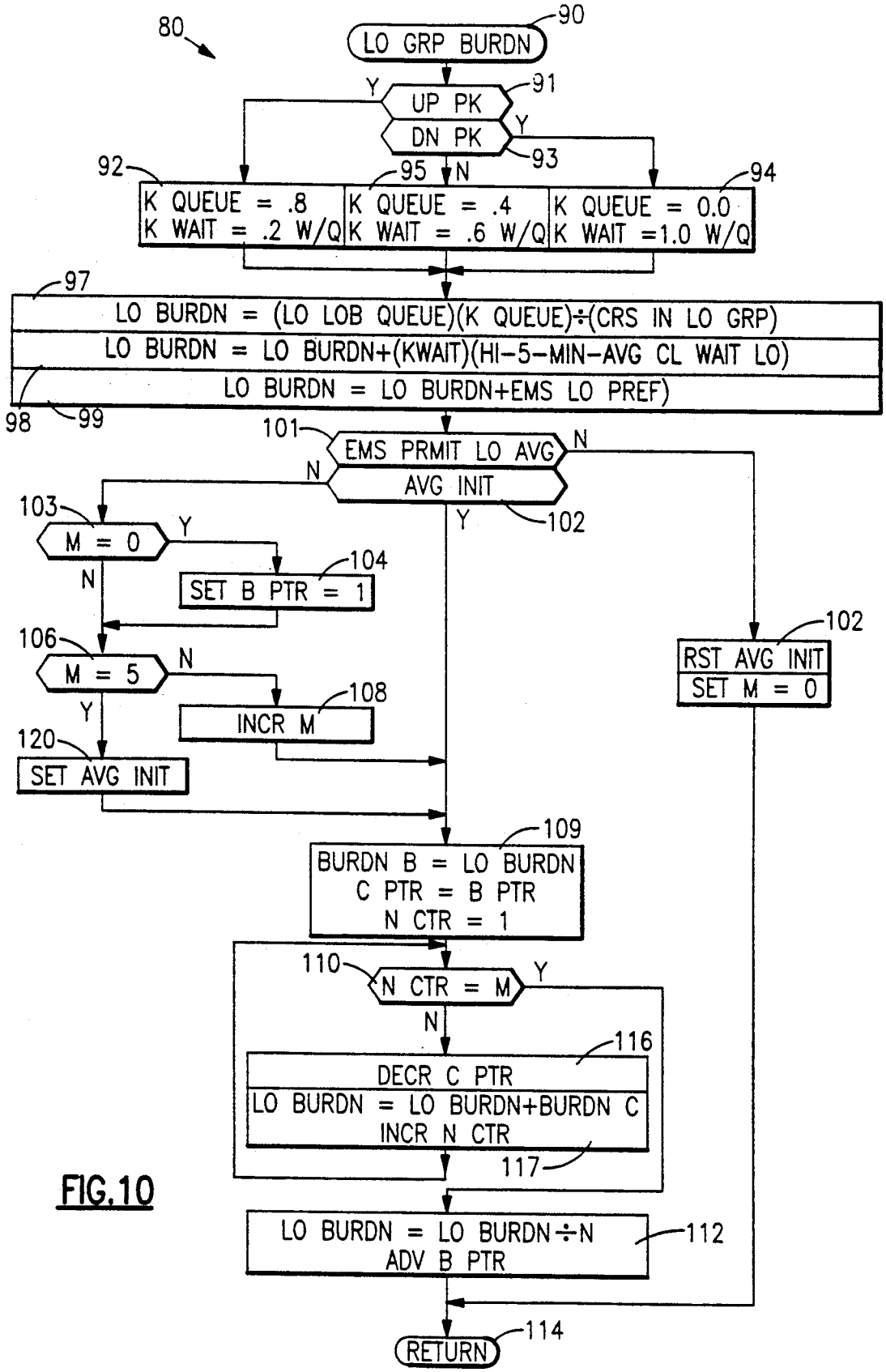
FIG. 10 is a logic flow diagram of a subroutine for determining the traffic burden in a low group (exemplary) which may be utilized in accordance with the present invention.

Referring now to FIG. 10, the low group burden software module 80 is reached through an entry point 90. A first step 91 determines if the elevator is in an up peak period; if so, an affirmative result reaches a pair of steps 92 wherein constants that weight the relative importance of lobby queue and passenger waiting time for calls are established. During up peak, the group having the largest number of passengers arriving at its lobby service corridor should be given preference over the other group unless such preference has caused passengers to have excessive delays in the other group. Thus, one might favor assignments based on lobby queue by causing the constant for lobby queue burden to be 8/10 and the constant for passenger waiting to be 2/10. As described more fully hereinafter, to facilitate biasing on the basis of how many passengers a car can hold, the constant for the waiting time also has a factor "W/Q" which converts seconds or minutes of average hall call waiting time into an equivalent load factor expressed in terms of number of people standing in a queue in the lobby. This is a fictitious number but is undertaken so that all burden can be expressed in a common metric, chosen herein to be number of people.

If the low group is not operating in an up peak period, a negative result of test 91 will reach a test 93 to determine if the group is operating under down peak conditions. If so, an affirmative result will reach a pair of steps 94 where the queue constant and waiting constant are set to different values. While these values can be selected and altered regularly to suit the needs of any building traffic patterns, the ones chosen herein for example only are that the queue constant be set to zero and the waiting constant be set to one times the conversion factor "W/Q". This means that during down peak, lobby floor passengers will be not considered in the determination of assigning swing cars, but only the average waiting time in two different groups will be considered. On the other hand, other values could be chosen to suit any particular scheme or traffic pattern.

If neither up peak nor down peak are in process, negative results of both tests 91 and 93 will reach steps 95 where still different values will be established for the constants. In this example, it is assumed that waiting for elevators at the floors is paramount since during off-peak, the interfloor traffic can be heavy. Therefore, the queue constant is set to 0.4 while the wait constant is set to 0.6. Of course, other constants could be used here as well. In accordance with the invention, since the cars can be swung back and forth between groups so readily, it may not even be necessary to have any constants at all. To effect such a thing, all of the constants in the steps 92, 94, 95 could be set to one so that they will have no effect on establishing burden in the group. And if desired, the W/Q conversion constant can, in some cases, be set to one, as well, as described hereinafter. The constants in each of the steps 92, 94, 95 are shown by way of example as having a total value of one; this is not necessary; any reasonable constants can be used so long as each step 92, 94, 95 has the same constants as the comparable steps in the medium group burden subroutine.

The burden for the group is built of different components in several stages. Low burden is the factor which identifies the burden attributed to the low group which can be compared to the burden attributed to the medium group in order for the building low/medium software module to pick which group should have the swing car assigned to it next. In the step 97, the low burden factor is initially established as a value for the queue in the low lobby (which can be determined by people counters in a manner known to the art) times the queue constant, all of which can be divided by the number of cars in the low group. This division is made so as to relate the burden to the ability to handle the burden. In that way, if the low group were operating say with only two dedicated cars, while the medium group had four dedicated cars, queues of equal amounts should be treated as if they are much greater burden to the low group than to the medium group. But if the low group had two swing cars assigned to it, the ability to handle equal burden would be about equal. Dividing by the number of cars in the group is an equalizer. It also works out that, as described more fully hereinafter, as a car is approaching the lobby and may have just been assigned to a group, it immediately gets counted in this step 97 so as to indicate that help is on the way. This tends to cause equalization of burdens the instant the car is assigned to a group. In a step 98, low burden has added to it the highest one of the average call waiting time for passengers in the low rise floors over the past five minutes. Of course some other period of time can be chosen or some other indicium of passenger waiting time can be chosen if desired. As described hereinbefore, by choosing the waiting constant to be zero, the time which passengers wait can be totally ignored, if desired in any use of the invention. In a step 99, low burden has added to it a preference established by the elevator management system (EMS); in a usual case, this preference may be zero, but it may be some value that would reflect the desire to have the performance in one of the rises better than performance in another. Such a case may occur if visiting dignitaries were utilizing floors in the low rise and the building management desired to assure superb service thereto. On the other hand, the preference can be negative and actually act as a penalty, if desired; this would have the effect of preferring medium over low, but leaving medium neutral with high; the same result could be had by adding preference to both medium and high.

The remainder of the subroutine of FIG. 10 only provides for averaging the calculated low burden over several calculations thereof, if desired. It is not necessary. It is assumed that if averaging is desired, then the elevator management system will establish a flag bit to permit averaging to be accomplished. If it does so, an affirmative result of a test 101 will reach a test 102 to determine if averaging has been initiated yet or not. In the first pass, the answer will be negative and therefore a test 103 will be reached wherein it is determined whether or not an "M" counter is set to zero or not. This counter determines the number of burden values to be averaged; it is initialized to zero on controller power-up initialization. In the first pass through this part of the routine, it will be zero and therefore an affirmative result of the test 103 will reach a step 104 wherein a "B" burden pointer is initialized at one. B is also the number of burden values to be averaged together, which, in the present case is assumed to be five. However, this again is a parameter which can be adjusted to suit any desired operation of an elevator system incorporating the invention. The B pointer is simply a set of bits wherein one is the lowest ordered bit, advancing to the next to lowest order bit indicates a pointer value of two, the third bit is a pointer value of three, and so forth. This is an end-around or cyclic pointer, so that when it reaches its highest setting of five it will advance to one again. In order to do averaging from the initial start up (whether it's when the low group burden is first run or upon a change from the EMS to do averaging when it formerly did not) without having falsely-low numbers (which would give the low group a disadvantage when compared to the medium group), the averaging is done only with the number of burden values which have been calculated up to the point of the current cycle. Thus in the first cycle, the original low burden is averaged with nothing. In the second cycle, it is averaged with one that was made before and the result is divided by two. In the third cycle, it is added to the two previous results and divided by three, and so forth. Use of the B pointer causes the values which have been saved to caterpillar: in each cycle the brand new value is loaded into a register pointed to by the B pointer, and the fifth oldest value is therefor erased. Therefore, in the first pass through the subroutine of FIG. 10, after establishing averaging, since the average initialization has not been established, the negative result of test 102 will reach a test 103 where a setable number, M, is tested to see if it is zero. The number M is set to zero when the computer control of the elevator is initialized after power on, and it is used in the initialization process to ensure that the final summation is divided by only the number of terms therein as the elevator begins averaging of its burdens following permission to do so in the test 101. Therefore, in the initial pass, M will be zero and an affirmative result of test 103 will reach a step 104 where a B pointer is set equal to one. This is a pointer that is advanced each time a burden is calculated so that it points to five temporary registers in a rotating fashion. After advancing from one to five it returns to one, and does it all over again, add infinitum. Next, a test 106 determines if the initialization process has advanced sufficiently so that M equals five. In the initial pass, M equals zero, so a negative result of test 106 reaches a step 108 where M is incremented from zero to one.

When averaging is being done, in each pass, a series of steps 109 cause the value of the burden stored at the current setting of the B pointer to be set equal to the value of low burden which was just calculated in this cycle in the steps 97-99. And, a C pointer is set equal to the B pointer. The C pointer is used to step backwardly and pick up earlier values of low burden to add into the averaging process. And, an N counter is set equal to zero. N is a number which causes the averaging process to have as many cycles (and therefore as many terms in the average) as dictated by the number M. During initialization, N is first one, then two, then three. Eventually, M is set to five so N will count to five then cause five recent calculations of low burden to be averaged together. Then, a test 110 determines if the N counter has advanced to the value of M, or not. During initialization, the first time that this test is reached the answer will be affirmative, since the N counter is set equal to one in the steps 109 and since the first pass has caused the step 108 to set the M counter to one. Therefore, an affirmative result of test 110 will reach a pair of steps 112 where the value of low burden is divided by N to get the final result; in this case, N is one, since it has not been incremented from its setting of one the steps 109, so the calculated value of low burden remains as it was. Then the B pointer is advanced so as to permit saving the next value of low burden in another register and other programming is reverted to through a return point 114.

In the next pass through the subroutine of FIG. 10, low burden is calculated in the steps 97-99 using appropriate constants, as described hereinbefore. The step 101 is reached; an affirmative result of that will cause a negative result of test 102 to reach test 103. Since M has been incremented to one in the previous pass, a negative result of test 103 will reach the test 106 to see if M has reached five yet, or not. In the second pass, M is still one so the step 108 increments M to two. Then, the steps 109 places the value of low burden which was just calculated in the steps 97-99 into the burden register pointed to by the B pointer, which was advanced in the step 112 to two in the previous pass. The N counter is again restored to the value one. Then the test 110 determines if the N counter is set equal to the value of M. Since M is now two, the result is negative and a step 116 decrements the C pointer to point to the previous value of low burden (the one that was stored during the first cycle) so that, in the pair of steps 117, low burden can be incremented by the value in the register pointed to by the C pointer. This causes the low burden to have two values of low burden added therein. Then the N counter is incremented, indicating that one earlier value of low burden has been added to the recently calculated value of low burden. Then the step 110 is again reached and this time, N is two so an affirmative result will reach the step 112 where low burden is divided by two and the B pointer is advanced so as to allow storing the third value in a third register. Then other programming is reverted to in step 114.

Eventually, the process will repeat until such time step 106 is affirmative indicating that there is now the capability of having M values averaged together for smoothing purposes, which is taken in this particular example as five. An affirmative result of test 106 reaches a step 120 which sets the "average initiated" flag. Then, the test and steps 109, 110, 116 and 117 will cause four earlier values to be added to the current value of low burden until N is incremented to five, where an affirmative result of step 110 will cause low burden to be divided by five, and the B pointer is advanced in the steps 112. This time the B pointer advances back to one, which it will do ad infinitum after reaching five. In the sixth pass (and subsequent) through the subroutine of FIG. 10, the step 102 will be affirmative so the steps 109 are reached directly. M remains at five from here on, until averaging is no longer permitted (which typically would be an entire day). Then, the currently calculated value of low burden is placed in the register pointed to by the B pointer, and the C pointer is used to step back and pick the prior values, while the N counter keeps track of the number of additions which have occurred and provides the correct division to make the average to come out correctly in the step 112.

Should the EMS determine that averaging should not be provided, it can reset the "EMS permit low averaging" flag so that a negative result of test 101 will reach a pair of steps 102 to reset the "average initiated" flag and set M equal to zero. In this way, should the EMS again permit averaging before power on initialization occurs, the process can repeat as described hereinbefore to establish proper operation.

It should be pointed out that the invention is not at all dependent upon averaging. Therefore, practice of the invention requires no more than generating low burden in some fashion, such as is described with respect to the steps and tests 91–99 hereinbefore.

The low burden value calculated as described with respect to FIG. 10, as well as a medium burden value calculated in the same way, are utilized for the building low/medium software module 83 to determine which rise should have the next swing car assigned to it. The process simply determines if low burden is equal to or greater than medium burden, and if so, sets a flag indicating that the low rise should be assigned the next available swing car. However, in the example herein, the ability to bias the burdens before making the determination is provided, as an option which is not necessary to the invention.

Figure 11:
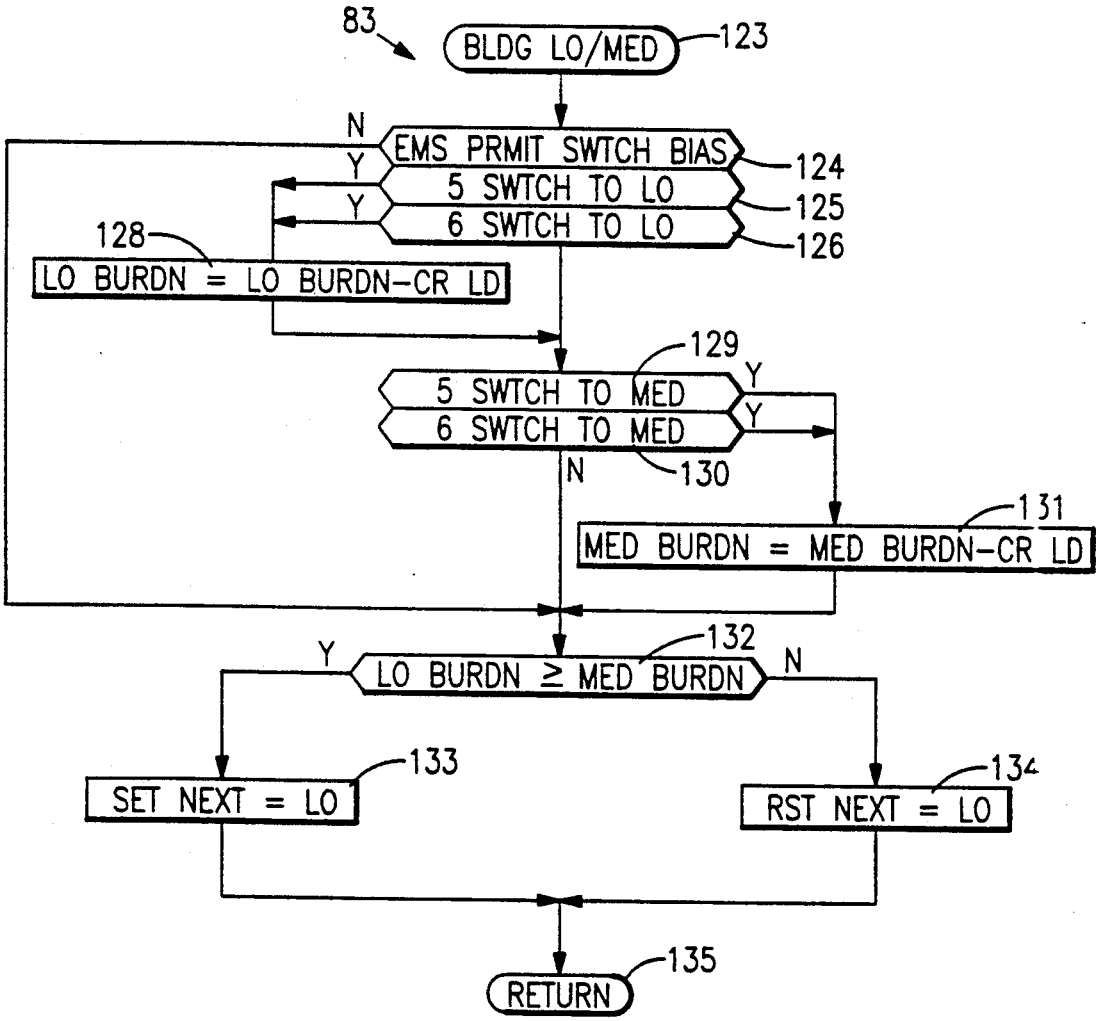
FIG. 11 is a logic flow diagram of an exemplary subroutine for determining the relative burden between the low and the medium group so as to designate which group should have the swing car assigned to it for its next run.

In FIG. 11, the subroutine 83 is reached through an entry point 123 and a first test 124 determines if the EMS is permitting biasing in determining switch car assignments. If it is, then a test 125 determines if car five has just now switched from medium rise to low rise; by that it is meant that its latest assignment is to the low rise whereas its previous assignment was to the medium rise. This may or may not be true in every assignment that occurs. Similarly, a test 126 determines if the last assignment of car six has been to the low rise when the previous assignment was to the medium rise. These two flags are established in the car software modules 85, 86, as is described with respect to FIG. 12 hereinafter. If either of the tests 125, 126 is affirmative, then a step 128 is reached wherein low burden (as provided by the software of FIG. 10) is reduced by some bias factor called "car load", which is some value related to the amount of passenger help that adding a car to one of the groups will provide. Thus, if the elevators have a 20 passenger capacity, this value might be on the order of 15 or 18, if desired; or, it may be less than that as suits the traffic requirements and performance that is desired in any building. Then a series of tests and a step 129–131 perform the same biasing function with respect to medium burden, if indicated. All of the steps and tests 125–131 are not necessary to the invention, and can readily be eliminated if desired. Further, if selectable use thereof is desired, then the EMS permit switch biasing flag tested in the test 124 can be used to cause a negative result of test 124 to bypass all of the steps and tests 125–131.

The actual determination takes place in a test 132 which simply determines if low burden is equal to or greater than medium burden. If it is, an affirmative result reaches a step 133 which sets a "next equal low flag"; if low burden is not equal to or greater than medium burden, then a negative result of test 132 reaches a step 134 which resets the "next equal low" flag, thereby causing the next car to be assigned to the medium rise. Thus the building determination of low or medium for the next assignment of a swing car is simply comparing burdens and either setting or resetting "next equal low", in the step 133, 134. After that, other programming is reverted to through a return point 135.

Figure 12:
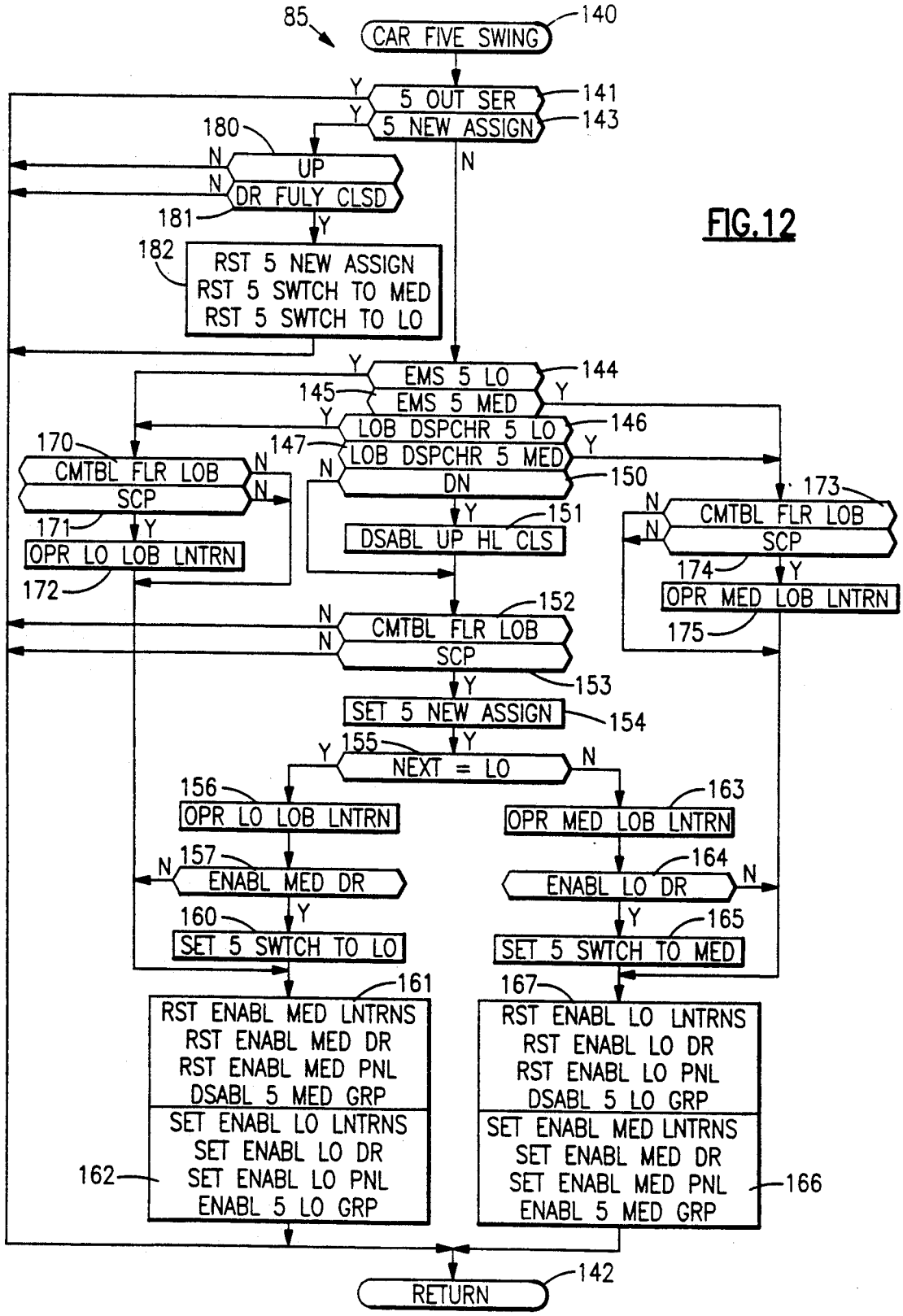
FIG. 12 is a logic flow diagram of an exemplary subroutine for performing the functions necessary to operate car five in either the low group or the medium group.

The "next equal low" flag (whether set or reset) is utilized in software modules 85, 86 for cars five and six, both of which can be assigned to either the low group or the medium group; the software module 85 is described for car five with respect to FIG. 12. The principal function is simply to determine which hall lanterns to operate and enable, which car panel to enable (to allow car calls), which doors to enable, which car floor lights to enable, and to which group the car should be assigned.

In FIG. 12, the car five swing software module 85 is reached through an entry point 140 and a first test 141 determines if car five is out of service, or not. If it is, other programming is reverted to through a return point 142, without performing any of the swing car assignment functions. In the usual case, car five will be in service and a negative result of test 141 will reach a test 143 to see if car five has a new assignment. In this embodiment, new assignment means it has been assigned, the lantern turned on, the car has approached the lobby, the doors are open and people are entering. When the doors close for the car to leave the lobby, the status of new assignment ends. This simply prevents any change in assignment after the lantern has been operated, thereby drawing the passengers of the assigned rise toward the elevator. Thereafter, as will be described hereinafter, there is no possibility of reassigning the elevator until it again reaches the stop control point of the floor lobby when traveling in the down direction. In any event, the usual case is not a new assignment so that a negative result of test 143 will reach a plurality of tests 144–147 to see if either the elevator management system or a lobby dispatcher has assigned car five relatively permanently to either the low rise group or the medium rise group, in a manner described more fully hereinafter. In the usual case of swing car operation, all of the tests 144–147 will be negative reaching a test 150 which determines if the elevator is traveling in the down direction or not. If it is, all up hall calls are disabled, which may be achieved, as in the relative system response method of assigning hall calls set forth in either of the aforementioned Bittar patents, simply by providing a disabling high penalty to any up hall call assignment for car five after the flag of step 151 is set. While the car is traveling upwardly, there is always a negative result of test 150, so step 151 is bypassed. The assignment begins with a test 152 which determines when the elevator reaches the point in its travel that the next committable floor is the lobby floor. In the case of car five, when it is operating in the low rise, this would be somewhere near floor number 2;. but when car five is operating in the medium rise, the lobby becomes the committable floor as the elevator reaches the express zone (somewhere around the lowest floor of the medium rise). During most of the passes through the car five swing routine 85 of FIG. 12, the elevator will be at other points in the elevator shaft and a negative result of test 152 will cause the remainder of the program to be bypassed, and other programming reverted through the return point 142. Eventually, the car, traveling down, reaches the point at which the lobby is the next committable floor, so an affirmative result of test 152 reaches a test 153 to determine if the stop control point has been reached, or not. This is the point at which, among other things, the lantern at the landing should be lit in order to inform passengers that the car is approaching. According to the present invention, the last moment at which the decision can be made as to whether the car should be in the low rise or the medium rise is the moment when the selected one of the lanterns 56, 57 has to be lit. This is because of the precept of the present invention that the passengers will readily approach an elevator in the lobby service corridor for the floors that they intend to reach when a lantern lights (usually with a gong). Thus, if the car is going to be assigned in its next run to the low rise group, the lantern 56 should be operated; then, the doors 50 should open so as to permit entrance of passengers from the low rise lobby service corridor 31. On the other hand, if car five is to be assigned to the medium rise group in its next run, the lantern 57 should be operated; then the doors 51 should open to permit access from passengers which are in the medium rise lobby service corridor 32. Thus, reaching the stop control point for the lobby floor (affirmative result of both tests 152 and 153) is where assignment takes place and the appropriate lantern 56, 57 is operated.

In a step 154 a new assignment flag for car five is set to indicate that no reassignment should occur until this flag is reset, as alluded to above and described more fully hereinafter. Then a test 155 examines the "next equals low" flag which was either set or reset the last time that the building low medium software module 83 was run, as described hereinbefore with respect to FIG. 11. If the flag is set, indicating that the next assignment of the swing car should be to the low group, then there will be an affirmative result of the test 155 which will reach a step 156 which will operate the car five low rise lobby lantern 56, in the low rise lobby service corridor 31, thereby announcing to passengers that this is a car which can serve their needs in the low rise of the building. Then a test 157 determines if the current run of car five was made in the medium rise by examining whether the medium doors are enabled. This is just a convenient test for whether car five was operating in the medium rise during the current run; other factors could be examined as well. If car five was in the medium rise in the current run, then its present assignment to the low rise for the next run is a switch, so an affirmative result of test 157 will reach a step 160 which sets the "five switch to low" flag; that is tested in test 125 of FIG. 11. in the event that biasing is to be performed to adjust for switching from one rise to the other.

Then in a series of steps 161, all the attributes of the car relating to the medium rise are reset. Specifically, the enablement of all of the lanterns for car five on floors 14–22 is reset, the enablement of the doors 51 on the medium rise side of the elevator is reset, the panel 53 (and a similar panel if any) near the medium rise doors, is no longer enabled, and car five is taken out of the medium rise group, which can be achieved by setting to zero the car five bit in a map of available cars in the medium group, as is described more fully in the aforementioned Bittar patents. Then, a series of steps 162 perform the converse functions to establish operation of car five in the low rise group. Specifically, enabling all of the lanterns for car five on floors 2–13, enabling the doors 50 for operation at successive floors, enabling the panel 52 (and a similar panel, if any) adjacent to doors 50 so that passengers can register calls for floors 1–13, and enabling car 5 in the low rise group by establishing its bit in the group as a logical one, or the like. It is also possible to cause the displays 54, 55 (FIG. 2) to warn passengers to "EXIT THROUGH OTHER DOORS" when a car is switching from one rise to another, in response to the flag of step 160.

If, instead, the "next equals low" flag had been reset by step 134 in FIG. 11, then a series of steps and tests 163–165, 167 provides the same functions for the medium rise as are provided for the low rise in the steps and tests 156–160, 162 and similar functions with respect to the low rise in steps 167 as are provided for the medium rise in the steps 161.

As described, the exemplary software for implementing the invention in FIG. 12 provides a substitute (steps 156, 163) for the normal prior art elevator structure that operates the lobby lanterns. It also provides a substitute function for enabling car five in either the low group or the medium rise group. On the other hand, it performs new functions in the enablement of the low doors and panels or the medium doors and panels, respectively. If desired, the operation of the lanterns could be performed in the same fashion as conventionally, provided an enablement is inserted to be sure that the correct lantern is operated at the lobby floor, and to be sure that the correct riser of lanterns is operated in floors above the lobby. In the case where the swing car is descending through an express zone, the next assignment of the swing car could be made and the selected lantern lit anywhere therein; but that is a trade-off with waiting as long as possible for a more accurate view of burden, to make a better choice.

In the event that one of the tests 144, 146 indicate that car five is relatively permanently assigned to the low rise group (such as to force an assignment during peak traffic), then an affirmative result of one of these tests will reach tests 170, 171 to operate the lantern 56 in step 172. Thereafter, the steps 161 and 162 are provided in the same fashion as when car five is operating as a swing car; when this is repetitively provided, it becomes redundant resetting and redundant setting, which is irrelevant.

In the event that either the elevator management system or a lobby dispatcher has relatively permanently assigned car five to the medium rise group, then an affirmative result of either test 145 or 147 will reach tests and steps 173–175 which cause operation of the medium rise lantern 57 in the same fashion as tests and steps 170–172 for the low rise lantern.

The software modules 86–88 provide in a similar fashion functions for car six in establishing its operation with either the low rise and the medium rise and functions for cars eleven and twelve with respect to establishing its operation with either the medium rise or the high rise.

As a car is assigned from one group to the other at the last moment, the step 154 will set the new assignment flag for car five. The test 143 at the top of FIG. 12 senses that fact and prevents any further assignment of the car until it later returns in the downward direction, having made a run in the assigned group. During the period of time between when the lantern is lit in the corridor of one rise or the other and when the doors close in anticipation of leaving the lobby level in an upward direction, no swing car assignment can be made because an affirmative result of test 143 prevents reaching the assignment process in the remainder of FIG. 12. Instead, a test 180 determines if the car is set for operation in the up direction or not. Initially it is not so the entire remainder of the flow chart of FIG. 12 is bypassed to the return point 142. Eventually, the direction will be switched to the up direction so that in a subsequent pass through the subroutine of FIG. 12, an affirmative result of the test 180 will reach a test 181 to determine if the doors are closed For a few passes, the result of test 181 will be negative and the remainder of FIG. 12 is bypassed to the return point 142. Eventually, the doors are closed as the upward run in the recent assignment begins. This reaches a set of steps 182 where the "five new assignment flag" of step 154 is reset and the fact that the elevator has recently been switched from one rise to the other is reset. This point is chosen to eliminate further biasing in FIG. 11 (should any be occurring) since the car is fully in service with respect to its new assignment. On the other hand, the resetting of these bias flags could be achieved at some other point, if desirable. The important thing with respect to the new assignment flag is that the elevator be assigned just as it lights the selected lantern so as to inform passengers of the correct corridor that it will be serving them, and no other assignments should occur until the elevator again is traveling in the down direction with the lobby as its committable floor.

In the light of the foregoing teachings, it should be apparent that relatively straight-forward choices are to be made depending upon the rise in which the elevator is to be operated. Specifically, doors, panels, lanterns and group control have to be selected. Otherwise, operation of the elevator is the same as it normally would be, with or without all the fancy accouterments of any sort of dispatching to answer calls, up peak/down peak, zoning, channeling, and the like. The essential functions just described need not be performed as illustrated in FIGS. 9-12, but may be performed utilizing the teachings herein by adapting existing elevator controls to be able to take advantage of the features of the invention: that the swing elevators can selectively open to admit passengers from lobby service corridors related to different floors of the building, and change from group to group on each run.

As far as a swing operation in accordance with the present invention serving different groups of floors are concerned, it is immaterial to the invention whether the groups include some of the same floors as well as mutually exclusive floors. As used herein, the notion of groups of different floors mean that some of the floors in one group are accessible by dedicated elevators that cannot access some of the floors in another group, and vice versa.

The invention can also be used for improved operation to secure floors, for instance, if there were a regular lobby service corridor serving all the floors of the building except for a few protected floors, and a number of swing cars disposed to both serve the regular lobby service corridor as well as a special lobby service corridor related to the protected floors. For a vision of this, consider the configuration shown in FIG. 7 without the elevators 62, wherein the elevators 61 would be called to the high corridor 66 to serve the protected floors in response to key operated lobby call buttons, or in response to hall calls registered on the protected floors. To ensure security for passengers entering swing cars 61 in response to key operated lobby calls in the high corridor 66, the cars could be not released for service (the doors to lobby 66 not open) until the load determining system has determined that the car is empty. In such a case, the doors would first open in the low corridor 65, the lights would turn off, an alarm could sound and the doors would begin to close slowly, to scare passengers out of the elevators, before the lights would be restored and the doors opened to the high corridor 66. In that sense, greater security can be provided using swing cars than sharing regular cars 60 with the unprotected floors. Such an arrangement also permits improved operation of the swing cars, one, two or three at a time, in a "protected group" containing the protected floors. Of course the foregoing could be extended to a situation where normal, low and high rise would be provided from the corridors 65 and 66 with the swing cars 61 used in either of the low or high groups, or upon call in a special group to protected floors or the like.

The invention need not provide for sharing between contiguous floor sets (LO/MED; MED/HI) as described with respect to FIG. 1. If the high rise corridor or the low rise corridor were placed in the center, then at least one (or two, as in the example of FIG. 1) of the swing cars would be shared by groups of non-contiguous floors (LO/HI), and the other one or more swing cars would be shared by groups of contiguous floors (MED/HI). If there are four or more groups in the building, all the swing cars could be shared by non-contiguous floor sets. The reason is that this is possible is that, if an elevator has to reach a high rise, it is immaterial whether the other doors and the like are provided for it in the low rise or the medium rise. In fact, if service overlap between one floor of the low rise and one floor of the high rise were desired, such would have to be the case (non-contiguous swing car sharing). The riser includes the enunciator lanterns and hall call buttons for up and down directions; the enunciator lanterns are adjacent to the gates of the related elevator hoistway.

Typical multirise elevator systems have the service corridors for non-lobby floors vertically aligned above the related lobby service corridor; this may be to serve two banks of elevators disposed on opposite sides of the service corridors. However, it has heretofore been necessitated by the single door elevator cabs. The present invention will allow having all service corridors (except the low rise lobby service corridor) vertically aligned with the high rise lobby service corridor. This would use one set of doors for access to the lobby, and use the opposite set for access to the non-lobby floors of the low rise.

Figure 13:
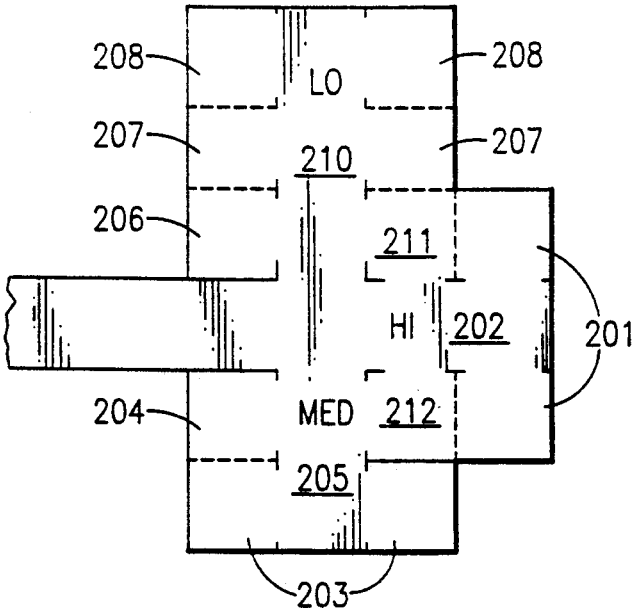
FIGS. 13, 14 and 15 are simplified sketches of additional configurations which may be implemented with the invention.

The elevators described with respect to FIGS. 1-8 hereinbefore have doors on opposite walls thereof, with lights and panels associated with such doors. The invention may also be practiced with corner swing cars, in which the cars have elevator doors on adjacent (rather than opposite) walls, as shown in FIG. 13. Therein, an elevator system 200 comprises a pair of high rise elevators 201 having doors opening on a high rise lobby service corridor 202, three medium rise elevators 203, 204 with doors opening on a medium rise lobby service corridor 205, five low rise elevators 206-208 with doors opening on a low rise lobby service corridor 210. A swing car 211 has doors opening on the low rise corridor 210 and on the high rise corridor 202. A swing car 212 has doors opening into the high rise corridor 202 and the medium rise corridor 205. This illustrates a case where sharing between high and low (non-contiguous sets) may occur. It also indicates that swing car elevator systems employing the notions of the present invention may be clustered in other than the tiers of FIG. 1.

FIG. 13 also illustrates additional notions. For instance, there are different numbers of elevators in each of the three rise groups shown in FIG. 13. This is irrelevant to the invention. If desired, by eliminating elevators 208, the system could operate with three low rise, three medium rise and two high rise elevators. By switching the high rise elevators from the corridor 202 with either the low rise or medium rise elevators of the corridors 205, 210, the system could have three high rise elevators, three of one of the other risers and two of the third rise. By eliminating either the elevators 207 or 203, the system could have three rises, one of which has only a single dedicated elevator. By eliminating the elevators 203, 207 and 208 one comes to an interesting configuration in which there are two of the rises (low and medium) having only one dedicated elevator each. The high rise has two elevators, which makes sense, since it has the further distance to travel; and the swing cars may normally be dedicated to the low and medium rise, either semi-permanently or on an every run basis as described hereinbefore. Of course, the corridor 202 could be used for the low or medium rise thereby providing two cars for whichever rise seemed most to be in need thereof. Furthermore, a single car could be placed in the corridor 202, between the two swing cars, so that the corridor 202 would extend only between the two swing cars 211, 212. In that case, with all of the cars 203, 207, 208 and one of the cars 201 eliminated, the system would reduce to only three dedicated cars and two swing cars. All of this is immaterial to the invention. The point is, with the advent of the present invention, a variety of new elevator system configurations are now possible to suit the needs of a variety of buildings, with a minimum number of elevator hoistways.

Figure 14:
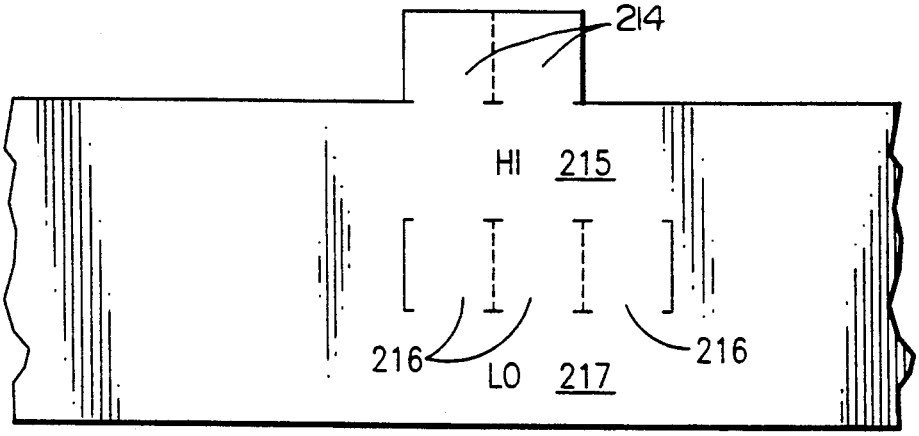
Figure 15:
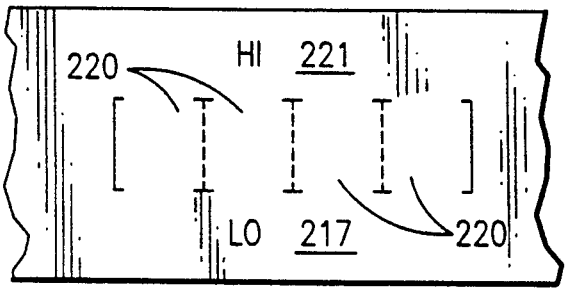

As shown in FIGS. 14 and 15, a unique embodiment may have no dedicated elevators for one of the rises (e.g., low rise). Therein, the cars 214 are dedicated to the high rise 215, but the cars 216 are swing cars to serve either the high rise 215 or the low rise 217. This would allow between two and five cars to serve the high rise; zero to three, the low rise. This could also be achieved in a three rise example by having only cars three-six and eleven-fourteen in FIG. 1, or by causing cars seven-ten to also be swing cars — or in other obvious ways. Such a system would provide a 100% shift in the number of cars serving the two outer rises (e.g., from 2 to 4; from 4 to 8). An ultimate embodiment would have no dedicated cars at all. This would be advantageous in tall, thin buildings. FIG. 15 illustrates this embodiment in which each of the elevators 220 is a swing car serving both a high rise corridor 221 (and corresponding upper floors) and a low rise corridor 222 (and corresponding floors). With only one row of hoistways, there is no between-hoistway. Low quality space on the lower floors, and the building core is smaller. The embodiments of FIGS. 14 and 15 (and any other embodiment in which one rise has no dedicated elevators) could have hoistways arranged so that the service corridors for all upper floors are above the lobby service corridor of one of the rises. This avoids having any low quality space beneath the service corridors of the upper rise and lowers the size of the building core. In this case, the display panels 54, 55, FIG. 2, could remind passengers to turn toward and leave by the opposite doors, when appropriate.

Although not described in detail hereinbefore, each of the elevators specifically referred to hereinbefore are deemed to be complete elevators having a hoistway within which the elevator travels to service the floors for which the hoistway has gates allowing passengers to travel to and from the various floors served by the hoistway. Each elevator of course has a car with panels and doors as described hereinbefore, the doors being included in door means which are operable to provide for transfer of passengers to and from the car, motion means causing the elevator to move within the hoistway and to stop at designated floors in response to car calls or to answer hall calls or to return to a preferential floor such as a lobby, providing signals between the car and the car controller indicative of conditions of operation of the car, and communicating in some fashion with a group control, so that the group control can react to the conditions in various cars to determine which cars should be assigned to answer calls and assign them to do so. The various lobby service corridors (such as 31–33 in FIG. 1) of course are associated with additional similar service corridors in the floors above the lobby to which the corridor relates (the low, medium or high rise floors). On each floor serviced by a particular elevator, that elevator has enunciator lanterns (usually including a gong) to announce the impending arrival of the related car in either the up or down direction, and hall call buttons to allow passengers to request service to that floor. Usually, the hall call buttons and groups of lanterns for all of the elevators that can serve the floor are deemed to be a "rise". With respect to the swing cars, car five, for instance, would have enunciator lanterns (such as lantern 56) in service corridors above the corridor 31 on floors 2–13, and would have lanterns such as lantern 57 in service corridors above the corridor 32 on floors 14–22.

As described with respect to FIGS. 11 and 12, the "next equals low" flag operates as a swing signal to indicate that the car should operate in one or the other of the groups; however, it is possible to have such signal be implicit. The building function could be replicated in each swing car, rather than set forth separately as modules 83 and 84 as described with respect to FIG. 9 hereinbefore. In such case, the result of functions controlling the assignment could simply cause the assignment to occur, without setting a flag bit (similar to the "next equals low" flag bit) in a separate controller. And, if the invention is implemented in software, obvious software simplification could be achieved by combining the group software module 83 with the car five and six swing modules 85, 86.

The functions described hereinbefore, as well as other car control, group control and/or building functions, including the elevator management system, may be provided by single signal processing means which may comprise one or more data processors, or by a plurality of signal processing means which may comprise individual or distributed data processors. Or, all of such functions may be performed by separate dedicated processors, as may suit any individual implementation of the present invention. Cars could be assigned in pairs, if desired, but there would not normally be any advantage thereto. All of this is irrelevant to the invention.

The exploitation of the notions of the present invention seem to be endless, and all of that is irrelevant to the invention.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

I claim:

1. An elevator system for serving a plurality of groups of floors in a building, each of said groups including at least one floor not included in any other one of said groups, each group including the same lobby floor, comprising:

a plurality of elevators, each including a car operating in a hoistway, car motion means for providing and arresting the motion of the car, car call means for registering requests for service initiated by passengers therein and for providing car call signals indicative thereof, door means for providing ingress to and egress from said car, and means for providing operation signals indicative of conditions of said car;

a plurality of risers, each related to one of said groups of floors and including up direction hall call buttons and enunciator lanterns for all of the floors in the related one of said groups except the highest floor and down direction hall call buttons and enunciator lanterns for all the floors in said related group except the lowest floor, said buttons operable to provide corresponding hall call signals indicative of service requested to floors of the related group;

a plurality of lobby service corridors, one for each one of said groups of floors, each one of said risers including a corresponding unique one of said lobby service corridors which is identified to prospective passengers as the lobby service corridor from which service can be had exclusively to a corresponding one of said groups of floors;

signal processing means associated with said elevators and responsive to said hall call signals, said car call signals, and said operation signals for assigning each of said hall call requests to a selected car, and for causing each of said car motion means to move the related car to appropriate floors and provide service indicated by corresponding ones of said car call requests and assigned ones of said hall call requests and for operating said enunciator lanterns to indicate a car approaching a floor to provide service;

characterized by one of said elevators having a hoistway with access to both of said groups of floors and both of said lobby service corridors, and having first doors disposed in a first wall and operable to permit passengers to transfer between it and said first lobby service corridor, and having first car call buttons relating to said first group of floors, and having second doors disposed in a second wall contiguous with said first wall and operable to permit passengers to transfer between it and said second lobby service corridor, and having second car call buttons related to said second group of floors, said doors providing access to both of said groups of floors; and said signal processing means comprising means operable during each run of said one elevator for enabling said one elevator to service said first group of floors, using said first doors for access to said first lobby service corridor and using said first car call buttons, during the following run, or for alternatively enabling said one elevator to service said second group of floors, using said second doors for access to said second lobby service corridor and using said second car call buttons, during the following run.

2. An elevator system according to claim 1 further characterized by:

said signal processing means comprising means operable each time that said one elevator approaches said lobby floor at the conclusion of a run to assign said one elevator to service one of said groups in the following run.

3. An elevator system for serving a plurality of groups of floors in a building, each of said groups including at least one floor not included in any other of said groups, each group including the same lobby floor, comprising:

a plurality of elevators, each including a car operating in a hoistway, car motion means for providing and arresting the motion of the car, car call means for registering requests for service initiated by passengers therein and for providing car call signals indicative thereof, door means for providing ingress to and egress from said car, and means for providing operation signals indicative of conditions of said car;

a plurality of risers, each related to one of said groups of floors and including up direction hall call buttons and enunciator lanterns for all of the floors in the related one of said groups except the highest floor and down direction hall call buttons and enunciator lanterns for all the floors in said related group except the lowest floor, said buttons operable to provide corresponding hall call signals indicative of service requested to floors of the related group;

a plurality of lobby service corridors, a first one of said risers including a first one of said lobby service corridors which is identified to prospective passengers as the lobby service corridor from which service can be had exclusively to a first one of said groups of floors, and a second one of said risers including a second lobby service corridor which is identified to prospective passengers as the lobby service corridor from which service can be had exclusively to a second one of said groups of floors;

signal processing means associated with said elevators and responsive to said hall call signals, said car call signals, and said operation signals for assigning each of said hall call requests to a selected car, and for causing each of said car motion means to move the related car to appropriate floors and provide service indicated by corresponding ones of said car call requests and assigned ones of said hall call requests and for operating said enunciator lanterns to indicate a car approaching a floor to provide service;

a first one of said elevators having a hoistway with access to said first lobby service corridor and service corridors on said first group of floors, having car call buttons relating to said first group of floors, and having doors operable to permit passengers to transfer between it and the service corridors of said first group of floors; and a second one of said elevators having a hoistway with access to said second lobby service corridor and service corridors on said second group of floors, having car call buttons relating to said second group of floors, and having doors operable to permit passengers to transfer between it and the service corridors of said second group of floors;

characterized by a third one of said elevators having a hoistway with access to said service corridors of both of said groups of floors and having first doors operable to permit passengers to transfer between it and service corridors of said first group, having first car call buttons relating to said first group of floors, having second doors operable to permit passengers to transfer between it and service corridors of said second group, and having second car call buttons related to said second group of floors; and said signal processing means comprising means operable before reaching said lobby floor at the end of each run of said third elevator for assigning said third elevator to alternatively service, in the following run, said first group of floors using said first doors and car call buttons or said second group of floors using said second doors and car call buttons.

4. An elevator system according to claim 3 further characterized by:

said signal processing means comprising means for alternatively enabling said third elevator to exclusively service said first group of floors or said second group of floors.

5. An elevator system according to claim 3 further characterized by:

said signal processing means comprising a first group controller for assigning hall call requests for service at said first group of floors to a first group of elevators including said first elevator and comprising a second group controller for assigning hall call requests for service at said second group of floors to a second group of elevators including said second elevator, and for assigning said third elevator to said first group controller or to said second group controller, alternatively.

6. An elevator system according to claim 3 further characterized by:

said plurality of floors including a third group of floors having said same lobby floor and at least one floor not in said first or second groups of floors;

a third lobby service corridor which is identified to prospective passengers as the lobby service corridor from which service can be had exclusively to said third group of floors;

a third one of said risers related to said third group of floors and including said third lobby service corridor;

a fourth one of said elevators having a hoistway with access to said third lobby service corridor and service corridors on said third group of floors and having access to said first lobby service corridor and service corridors on said first group of floors, having first doors operable to permit passengers to transfer between it and service corridors of said third group of floors, having first car call buttons related to said third group of floors, having second doors operable to permit passengers to transfer between it and service corridors of said first group of floors, and having second car call buttons related to said first group of floors; and said signal processing means comprising means operable before reaching said lobby floor at the end of each run of said fourth elevator for assigning said fourth elevator to alternatively service, in the following run, said third group of floors using said first doors and car call buttons, or said first group of floors using said second doors and car call buttons.

7. An elevator system according to claim 6 further characterized by:

said signal processing means comprising means for making an assignment of said third elevator to service said first group of floors only at times different from the times of making an assignment of said fourth elevator to service said first group of floors.

8. An elevator system for serving a number of floors of a building, including a swing car which may be transferred between operation servicing a first set of floors and operation servicing a second set of floors different from said first set of floors, comprising:

a first riser including a first set of up direction hall call buttons and enunciator lanterns for all of said first set of floors except the highest thereof, including a lobby floor, and down direction hall call buttons and enunciator lanterns for all of said first set of floors except the lowest thereof, said buttons operable to provide first hall call signals indicative of requested service;

a second riser including a second set of up direction hall call buttons and enunciator lanterns for all of said second set of floors except the highest thereof, including said lobby floor, and down direction hall call buttons and enunciator lanterns for all of said second set of floors except the lowest thereof, said buttons of said second set operable to provide second hall call signals indicative of requested service;

a plurality of elevators, each including a car operating in a hoistway, car motion means for providing and arresting the motion of the car, car call means for registering requests for service initiated by passengers therein and for providing car call signals indicative thereof, door means for providing ingress to and egress from said car, and means for providing operation signals indicative of conditions of said car, at least one of said elevators being disposed in a first group for servicing floors of said first riser and at least one of said elevators being disposed in a second group for servicing floors of said second riser, and one of said elevators being a swing car;

signal processing means responsive to said first hall call signals, and to said car call signals and said operation signals of said first elevator, for assigning each of said first hall call requests to a selected car of said first group, and for causing each of said car motion means to move said selected car to appropriate floors and provide service indicated by corresponding ones of said car call requests and assigned ones of said first hall call requests, and for operating enunciator lanterns of said first set to indicate a car approaching a floor to provide service, said signal processing means responsive to said second hall call signals, and to said car call signals and said operation signals of said second group of elevators, for assigning each of said second hall call requests to a selected car of said second group, and for causing each of said car motion means to move said selected car to appropriate floors and provide service indicated by corresponding ones of said car call requests and assigned ones of said second hall call requests, and for operating enunciator lanterns of said second set to indicate a car approaching a floor to provide service;

characterized by:

said swing car being capable of operating in said first group servicing floors of said first riser and capable of operating in said second group servicing floors of said second riser; and said signal processing means comprising means operable before reaching said lobby floor at the end of each run of said swing car to assign said swing car to one of said groups for service either to floors of said first riser or to floors of said second riser, respectively.

9. An elevator system for serving a plurality of groups of floors in a building, each of said groups including at least one floor not included in any other one of said groups, each group including the same lobby floor, comprising:

a plurality of elevators, each including a car operating in a hoistway, car motion means for providing and arresting the motion of the car, car call means for registering requests for service initiated by passengers therein and for providing car call signals indicative thereof, door means for providing ingress to and egress from said car, and means for providing operation signals indicative of conditions of said car;

a plurality of risers, each related to one of said groups of floors and including up direction hall call buttons and enunciator lanterns for all of the floors in the related one of said groups except the highest floor and down direction hall call buttons and enunciator lanterns for all the floors in said related group except the lowest floor, said buttons operable to provide corresponding hall call signals indicative of service requested to floors of the related group;

a plurality of lobby service corridors, one for each one of said groups of floors, each one of said risers including a corresponding unique one of said lobby service corridors which is identified to prospective passengers as the lobby service corridor from which service can be had exclusively to a corresponding one of said groups of floors;

signal processing means associated with said elevators and responsive to said hall call signals, said car call signals, and said operation signals for assigning each of said hall call requests to a selected car, and for causing each of said car motion means to move the related car to appropriate floors and provide service indicated by corresponding ones of said car call requests and assigned ones of said hall call requests and for operating said enunciator lanterns to indicate a car approaching a floor to provide service;

characterized by each of said elevators having a hoistway with access to two of said lobby service corridors and both of said groups of floors corresponding thereto, and having first car call buttons relating to one of said two groups of floors and having first doors operable to permit passengers to transfer between it and the corresponding lobby service corridor, and having second hall call buttons related to the other of said two groups of floors and having second doors operable to permit passengers to transfer between it and the other corresponding lobby service corridor, said doors providing access to said two groups of floors; and said signal processing means comprising means operable before reaching the lobby floor at the end of each run of each one of said elevators for assigning each of said elevators to service, in the following run, either one group of floors to which it has access using said first doors for access to the lobby service corridor corresponding thereto and using said first car call buttons or another group of floors to which it has access using said second doors for access to the lobby service corridor corresponding thereto and using said second car call buttons.

10. An elevator system according to claim 9 further characterized by:

said signal processing means comprising means for alternatively enabling each of said elevators to exclusively service one of the groups of floors to which it has access.

11. An elevator system according to claim 9 further characterized by:

said signal processing means comprising means for making an assignment of one of said elevators to service a given one of said groups of floors only at times different from the times of making an assignment of another of said elevators to service said given group of floors.

12. An elevator system according to claim 9 further characterized by:

said system including less than four of said groups of floors and corresponding lobby service corridors.

13. A system according to claim 3 wherein said signal processing means comprises means for selectively operating the doors to permit passenger egress from the car at the conclusion of a current run into the lobby service corridor related to floors of the group to which the car is assigned for the next following run.

14. A system according to claim 6 wherein said signal processing means comprises means for selectively operating the doors to permit passenger egress from the car at the conclusion of a current run into the lobby service corridor related to floors of the group to which the car is assigned for the next following run.

15. A system according to claim 8 wherein said signal processing means comprises means for selectively operating the doors to permit passenger egress from the car at the conclusion of a current run into the lobby service corridor related to floors of the group to which the car is assigned for the next following run.

16. A system according to claim 9 wherein said signal processing means comprises means for selectively operating the doors to permit passenger egress from the car at the conclusion of a current run into the lobby service corridor related to floors of the group to which the car is assigned for the next following run.

17. A system according to claim 3 wherein said signal processing means comprises means for comparing the traffic burden within said first group of floors with the traffic burden within said second group of floors and for selectively enabling the third elevator to service said first group of floors or said second group of floors in dependence upon which of the groups has the highest traffic burden.

18. A system according to claim 6 wherein said signal processing means comprises means for comparing the traffic burden within said first group of floors with the traffic burden within said second group of floors and for selectively enabling the third elevator to service said first group of floors or said second group of floors in dependence upon which of the groups has the highest traffic burden.

19. A system according to claim 8 wherein said signal processing means comprises means for comparing the traffic burden within said first group of floors with the traffic burden within said second group of floors and for selectively enabling the third elevator to service said first group of floors or said second group of floors in dependence upon which of the groups has the highest traffic burden.

20. A system according to claim 9 wherein said signal processing means comprises means for comparing the traffic burden within said first group of floors with the traffic burden within said second group of floors and for selectively enabling the third elevator to service said first group of floors or said second group of floors in dependence upon which of the groups has the highest traffic burden.

21. In a multi-elevator system including a plurality of elevators grouped into at least first and second elevator groups for service under mutually independent group controls, said first and second elevator groups having mutually independent first and second service corridors on the same lobby floor for access to the relevant floors, a variable grouping system comprising:

at least one of said elevators comprising a swing car disposed within a hoistway having access to both groups of floors, having first doors, hall lanterns and car call buttons for servicing said first group of floors and having second doors, hall lanterns and car call buttons for servicing said second group of floors; and a controller for periodically comparing the level of traffic within said first group of floors with the level of traffic within said second group of floors and, in response thereto, providing a next car assignment signal indicative of the group of floors to which the next swing car assignment should be made in dependence on which group has the higher level of traffic burden, said controller, as said swing car approaches said lobby floor at the completion of each assigned run, operating the lobby hall lantern, and enabling the remaining hall lanterns, doors, car call buttons, and group response of said car for the selected group identified by said next car assignment signal, disabling the hall lanterns, doors, and car call buttons of said car for the other group, and dispatching said swing car in said selected group.

22. A system according to claim 21 wherein said controller determines the level of traffic within each of said groups as a function of the number of passengers queued up for service at the lobby service corridor corresponding to such group.

23. A system according to claim 21 wherein said controller determines the level of traffic within each of said groups as a function of average hall call waiting time of passengers in such group.

24. A system according to claim 23 wherein said controller determines the level of traffic within each of said groups as a function of the number of passengers queued up for service at the lobby service corridor of such group.

25. A system according to claim 24 wherein said controller determines the level of traffic within each of said groups mainly in response to the number of passengers queued up for service at the lobby service corridor of such group during an up-peak period and mainly in response to the average hall call waiting time of passengers in such group during a down peak.

26. A system according to claim 21 wherein said controller determines the level of traffic within each of said groups is determined as a function of the traffic burden per car in the group.

27. A system according to claim 21 wherein said controller determines the level of traffic within each of said groups as a traffic burden per car assigned to the group, taking into account a swing car newly assigned to the group.

28. A system according to claim 21 wherein said controller provides said next car assignment signal in dependence upon which group has the higher level of traffic burden and in dependence upon a predetermined preference for assigning said swing car to one group or the other.

29. A system according to claim 21 wherein said swing car completes an assigned run when it is at the stop control point of its committable floor and its committable floor is the lobby floor.

* * * * *